United States Patent [19]

Kramer

[11] 4,053,725

[45] Oct. 11, 1977

[54] PRESSURE SWITCH FOR OUTDOOR REFRIGERATION SYSTEMS

[76] Inventor: Daniel E. Kramer, 2009 Woodland Drive, Yardley, Pa. 19067

[21] Appl. No.: 674,572

[22] Filed: Apr. 7, 1976

[51] Int. Cl.[2] ..... H01H 35/34

[52] U.S. Cl. ..... 200/81 R; 62/468; 73/393; 200/83 Y; 219/505

[58] Field of Search ..... 200/81 R, 81.5, 83 Y, 200/83 D; 219/201, 209, 210, 504, 505, 511; 62/468, 472; 73/393

[56] References Cited

U.S. PATENT DOCUMENTS

| | | | |
|---|---|---|---|
| 2,557,929 | 6/1951 | Bask | 200/81.5 |
| 2,825,781 | 3/1958 | Mitchell | 200/81.5 |
| 3,564,199 | 2/1971 | Blaha | 219/505 |
| 3,940,591 | 2/1976 | Ting | 219/505 |
| 3,973,102 | 8/1976 | Macklem | 219/511 |

*Primary Examiner*—Gerald P. Tolin

*Attorney, Agent of Firm*—Daniel E. Kramer

[57] ABSTRACT

A pressure switch for use in refrigeration systems which includes a restrictor to minimize the effect of compressor pulsations on the pressure sensing element and a heater positioned to warm the interior of the switch housing and to maintain the fluidity of refrigeration oil traversing the restrictor under conditions when the switch is exposed to low ambient temperatures.

6 Claims, 2 Drawing Figures

PRESSURE SWITCH FOR OUTDOOR REFRIGERATION SYSTEMS

BACKGROUND

1. Field of the Invention

This invention pertains to refrigeration systems of the type which employ a volatile fluid circulated between a condenser and an evaporator by a compressor, where the compressor or its controls are expected to be exposed to low winter ambient temperatures. The invention relates further to pressure controls for these systems intended to sense either refrigerant vapor pressure or oil pressure and open or close switches in response thereto.

Bellows-type pressure controls which are applied to refrigeration systems which use reciprocating compressors require a restricting element between the bellows and the point at which pressure is sensed for the purpose of smoothing the pressure pulsations generated by the compressor. These pulsations, if applied to the bellows without damping, would cause early bellows fatigue and failure. When pressure sensing elements of this sort are applied in low outdoor ambients, as in connection with refrigeration condensng units located outdoors under low temperature conditions, oil, which is circulated with the refrigerant, gets trapped in the restrictive element; either unavoidably, as in controls which measure and react to oil pressure; or inadvertently as in controls which measure suction vapor pressure. The congealed oil becomes an effective barrier to the flow of sufficient fluid to communicate the desired pressure from the system to the bellows and the control becomes inoperative.

2. Prior Art

To date I am not aware of any structure which has been constructed or arranged or intended for the purpose of deliberately providing a warmer-than-normal environment around a pressure control and its associated restricting element for the purpose of enabling the switch to operate correctly at low outdoor ambients.

SUMMARY OF THE INVENTION

A pressure control including one or more pressure sensing elements such as diaphragms or bellows, each having a restrictor for reducing the communication of pressure pulsations to the pressure-sensing element all intended for use outdoors and subject to low winter ambients, an enclosure and a heater positioned to warm the pressure sensing element and its associated restrictor.

DETAILED DESCRIPTION OF THE DRAWINGS

Figure 1:
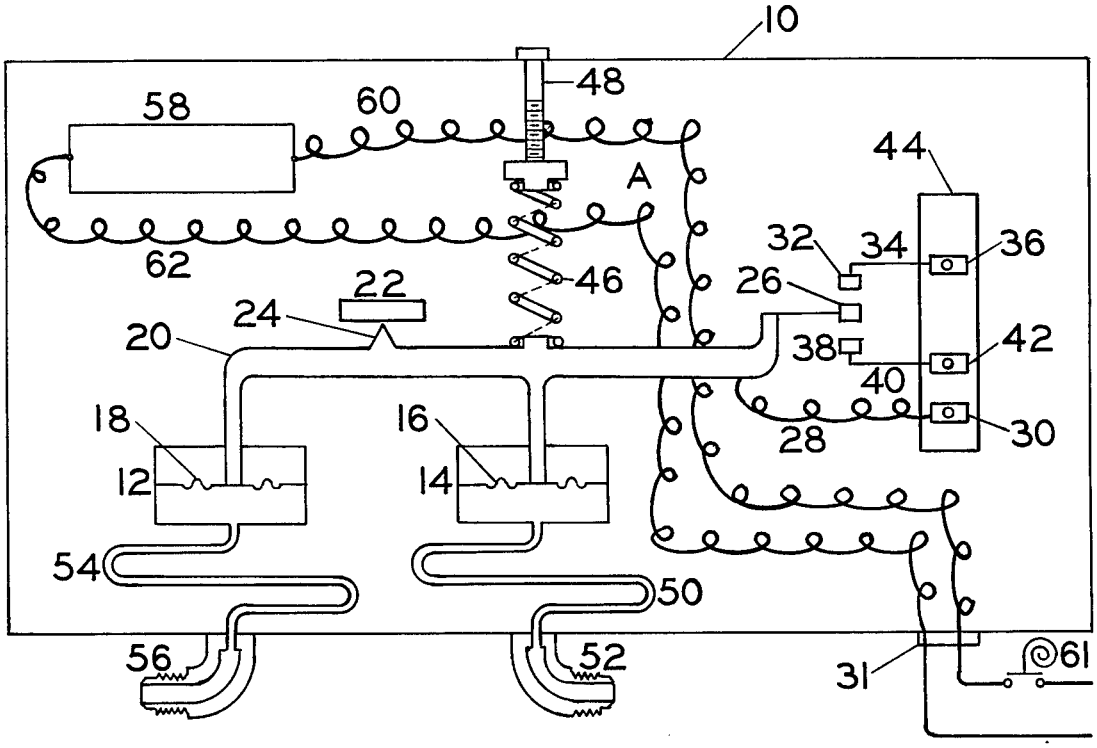
FIG. 1 shows an enlarged schematic representation of a typical oil pressure failure switch used on a refrigeration system with the cover removed, in which is located a heating element which serves to warm the interior of the enclosure.

FIG. 1 is a schematic representation of an oil failure switch used in refrigeration systems. Some oil failure switches include a built-in time delay device which prevents the switch from turning off the compressor for a measured period of time after the control detects insufficient oil pressure. Many of the time delay devices used in oil failure switches have resistors installed whose purpose is the reduction of voltage to the timing element to produce the correct time delay. Although this resistance and the time delay element itself do create a heating effect within the case, the heating effect of these two elements takes place only for the brief period between the time that the time delay has been actuated by low oil pressure and the time the delay opens the pilot circuit to the compressor, stopping it. I do not claim as my invention these time delay heaters. The oil switch shown in FIG. 1 does not have such a built-in time delay since its presence or absence is not germane to the invention. The mechanism of the pressure switch is enclosed in case 10. Fitting 52 is mounted on the exterior of the case and includes a flare connection for connection by a comparatively large tube, such as 0.25 inches OD, to the discharge or high pressure side of the compressor lubrication oil pump. Fitting 52 is connected via capillary tube 50, which may have a bore of 0.030 inches or smaller, to diaphragm case 14, which contains diapharagm 16. The diaphragm 16 is a flexible sheet of stainless steel corrugated in concentric rings and adapted to flex respectively as the difference in pressure between one side and the other changes. Bearing on the upper side of diaphragm 16, which is open to the atmosphere, is a portion of lever 20, whose fulcrum is knife edge 24. On the other side of fulcrum 24, another portion of the lever 20 bears on diaphragm 18, which is within diaphragm case 12 connected to the lower pressure connection 56 of the oil safety switch by restrictor 54, which is the same diameter tubing as restrictor 50. Range spring 46 bears on the high pressure side of lever 20 in a direction to oppose motion of the diaphragm generated by the pressure from pump discharge connection 52. Adjustment screw 48 is provided to compress range spring 46 more or less in order to change the pressure setting at which switch contact 26 moves from stationary contact 38 to stationary contact 32. Contacts 30, 36 and 42 are connected as required to the external control circuit. The pressure switch is mounted on the chassis of a refrigeration condensing unit including compressor which is installed outdoors. During winter conditions it is likely that the compressor will not operate for long periods. During these long compressor off periods the temperature of the oil in restrictors 50 and 54 will drop to the same temperature as the outdoor ambient. At 0° or below the oil will become so viscous that the pump pressure communicated to fitting 52 through the ¼ inches tube will not be communicated through the restrictors to the interior of the diaphragm chambers. The compressor will operate then with the pressure switch indicating that the pump is not delivering any oil pressure and consequently the contacts will be in a position to cause the control circuit to stop the compressor. To overcome this problem, heater 58 is installed within the pressure switch housing. Heater 58 typically has a wattage between 7 and 15 for a switch casing whose external dimensions are 3 x I-3/4 x 6. For ambient temperatures down to −20°, approximately 8 watts is sufficient to raise the temperature of the interior of the case about 30° over ambient. This produces an interior temperature of 10° at -20°, sufficient to allow the oil contained within the restrictors to flow sufficiently freely to actuate the diaphragms in accord with the pressure delivered to them through their inlet fittings. The heater 58 may be left energized continuously since a 30° temperature rise inside the case will not produce a temperature there sufficiently high to cause any damage even during conditions of hottest summer weather. If it is necessary to cope with even more extreme conditions of low ambient temperature, a heater of larger wattage can be employed controlled by a thermostat 61 positoned to sense the temperature outside the case. Outside thermostat 61 energizes the heater when the ambient temperature falls below 40°, for example, and de-ergizes the heater when the outside ambient rises above 60°, for example. With the thermostat 61 located inside the casing, at "A", thermostat settings 15° to 20° lower may be used. These temperatures are illustrative and may vary widely so long as the temperature at the restrictor is maintained above that temperature at which oil congelation and therefore control malfunction occurs. I have found that no malfunctions occur in Refrigerant 502 systems when the temperature in the casing is maintained above 0° F.

Figure 2:
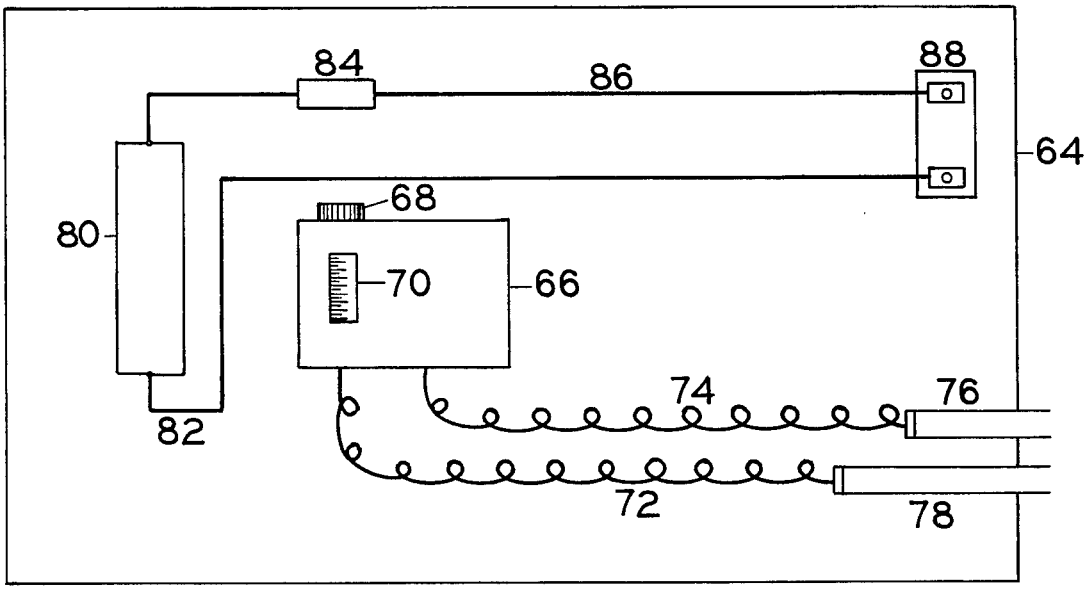
FIG. 2 shows the interior of an enclosure which is large enough to contain an entire pressure switch with external restrictors and a heater, mounted external of the pressure switch but within the enclosure, to increase the temperature around the pressure switch and restrictors to such a level that malfunction will not occur.

FIG. 2 shows a pressure control having restrictors in the form of long capillary tubes at the end of which are pressure connections for connection to larger lines. With a control of this type a heater inside the casing 66 would not be able to affect the temperature surrounding the long external restrictors 72 and 74. In FIG. 2, therefore, the entire pressure switch and the restrictors are mounted inside of a larger enclosure 64. The enclosure 64 is rigid, made, for instance, of steel or aluminum, although flexible material, for instance plastic sheet, may be used as an alternate. Within the enclosure is a heater 80 of sufficient wattage to warm the interior of the enclosure to a temperature about 30° higher than the temperature of the surrounding ambient. In the event cabinet 64 is to be exposed at times to very low ambients, high wattage, heater 80 must be employed to cope with those low ambients. Then thermostat 84 is provided to turn on the heater when the temperature inside the cabinet falls below 40° and turn off the heater when that temperature rises above 60° to prevent overheating.

The thermostat settings stated are illustrative since other settings may be used with complete satisfaction. For instance, a thermostat sensing the temperature within the heated enclosure may be set: ON +10° OFF +15°, or ON +90° OFF +100°. A thermostat sensing the temperature without the heated enclosure may be set: ON +5° OFF +10°, or ON +60° OFF +70°. In an alternate construction heaters 80 and 58 are Positive Temperature Coefficient Resistors (PTCR) constructed to inherently limit their heating effect at 40° to 60° ambient surrounding them. If the heaters are PTCR, no thermostat is ever needed. Equivalent construction may have restrictive orifices substituted for tubular restrictors 50 or 54.

Although the invention has been shown in connection with certain specific embodiments, those skilled in the art will readily recognize that various changes in form and arrangements of parts may be made to suit individual requirements without departing from the spirit and the scope of the invention except as defined and limited by the following claims.

I claim:

1. Improved pressure control means comprising a casing, a switch within the casing, pressure responsive means within the casing for actuating the switch during summer ad winter conditions; a connection; restricted conduit means joining the pressure responsive means to the connection for communicating pressure from the connection to the pressure responsive means wherein the improvement comprises; heating means for warming said restricted means.

2. Pressure control means as in claim 1 which includes thermostat means connected to the heating means for preventing the heating means from overheating the restricted means.

3. Pressure control means as in claim 2 where the thermostat means is within the casing.

4. Pressure control means as in claim 2 where the thermostat means is without the casing.

5. Pressure control means as in claim 1 where the heating means is within the casing.

6. Pressure control means as in claim 1 where the heating means is without the casing.

* * * * *

UNITED STATES PATENT AND TRADEMARK OFFICE

CERTIFICATE OF CORRECTION

PATENT NO. : 4,053,725

DATED : October 11, 1977

INVENTOR(S) : Daniel E. Kramer

It is certified that error appears in the above-identified patent and that said Letters Patent are hereby corrected as shown below:

Column 3, line 18, delete "de-ergizes" and insert in its place -- deenergizes --.

In Claim 1, line 28, delete "ad" and insert in its place -- and --.

In Claim 1, line 31, after the word "means" insert -- ; --.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*